US005372906A

United States Patent [19]

Haneda et al.

[11] Patent Number: 5,372,906

[45] Date of Patent: Dec. 13, 1994

[54] IMAGE FORMING METHOD

[75] Inventors: Satoshi Haneda; Hiroyuki Nomori, both of Hachioji, Japan

[73] Assignee: Konica Corporation, Japan

[21] Appl. No.: 6,693

[22] Filed: Jan. 21, 1993

Related U.S. Application Data

[63] Continuation of Ser. No. 472,741, Jan. 31, 1990, abandoned.

[30] Foreign Application Priority Data

Feb. 8, 1989 [JP] Japan ..... 1-30481
Apr. 11, 1989 [JP] Japan ..... 1-92660

[51] Int. Cl.[5] ..... G03G 1/00; G03G 13/14
[52] U.S. Cl. ..... 430/126; 430/56; 430/45; 430/46
[58] Field of Search ..... 430/126, 56, 45, 46

[56] References Cited

U.S. PATENT DOCUMENTS 4,547,447 10/1985 Ueda ..... 430/78
4,756,985 7/1988 Haneda et al. ..... 430/42
4,897,330 1/1990 Shoji et al. ..... 430/54
4,921,768 5/1990 Kunugi et al. ..... 430/45

*Primary Examiner*—Marion E. Mc Camish
*Assistant Examiner*—Rosemary Ashton
*Attorney, Agent, or Firm*—Jordan B. Bierman

[57] ABSTRACT

A toner image forming method is disclosed. In the method a photoreceptor having a shorter circumferene than length of a toner image to be transferred is used. The photoreceptor is exposed with an exposing light according to an image information to form a latent image and is processed with a step of removing residual toner particles on a non-image portion on the photoreceptor and developing a latent image on the photoreceptor with toner particles at a same time or successively to form the toner image. The toner particles have a specral characteristics which allows tho exposing light to pass through the toner particles. The method allows to provide a compact copying apparatus.

8 Claims, 4 Drawing Sheets

IMAGE FORMING METHOD

This application is a continuation of application No. 07/472,741 filed Jan. 31, 1990, now abandoned.

BACKGROUND OF THE INVENTION

This invention relates to an image forming method using an electrostatic latent image and, more particularly, to an image forming method in which transparent toner, through which exposing light can pass, is used.

Recently, a compact copier has been developed and development is proceeding briskly. In a series of image forming means in which a photoreceptor with a small circumference is used, a compact image recording apparatus is proposed in which the residual toner is electrically removed from the photoreceptor in the developing area. This type of image forming apparatus is disclosed in Japanese Patent Publication Open to Public Inspection No. 133179/1988, 133180/1988, and 133171/1988.

However, problems stemming from residual toner on the photoreceptor can be found, such as uneven charging in the charging process, light decay in the exposure process, and ghosting, and color muddiness in the image forming process. Because the circumference of the photoreceptor is shorter than the length of the toner image, a portion of the photoreceptor's circumference Is used twice to form a toner image and some portions of a toner image are periodically printed. For that reason, part of the toner is left on the photoreceptor without being cleaned off and the residual toner particles on the circumference of the photoreceptor obstruct image formation.

Especially when a coherent laser beam is used to expose an image, a defective image tends to appear in the portion shaded by opaque residual toner. Especially when the residual toner is scattered in spots, image quality is remarkably damaged.

Photoconductive semiconductors which have been used in conventional electrophotography are; inorganic photoconductive materials such as selenium, zinc oxide, cadmium sulfide, and cadmium selenide; photoconductive pigments such as phthalocyanine, copper phthalocyanine, cobalt phthalocyanine, and nickel phthalocyanine; and organic photoconductive materials such as poly-N-vinyl carbazole, anthracene, and triallyl amine derivative. These compounds are dispersed in the binder resin to form a photoreceptor. In order to rapidly make a plurality of copies in a short time, a highly sensitive photoreceptor which has very rapid light decay characteristics was developed. For that reason, a photoreceptor has been used which has high sensitivity in the low magnitude of light exposure region, wherein its light decay is sensitive even in low magnitude of light exposure and its light decay curve sharply declines in the low illuminance region.

It is known that there are two methods of forming a latent image on a photoreceptor by image exposure. One is the positive exposure system in which the non-image area is exposed to erase electrical charge on the photoreceptor and a latent image is formed. The other is the negative exposure system in which the image area is exposed to erase electric charge on the photoreceptor.

The digital image forming method is conveniently used to convert images freely, adjust images, and send images by facsimile. The light distribution of the spot of light which is used in dot exposure of the digital image forming method, is similar to a normal distribution curve in which the peak is the center of the spot, even though the spot of light is modulated by the method of pulse-duration modulation. The light energy distribution curve has long gentle slopes on both sides with wave patterns of light intensity caused by diffraction. In the case of the positive exposure system, these wave patterns are so remarkable that they can be the cause of photographic fog. That is the reason why the negative exposure system is suitable for dot exposure. However, it is necessary for the negative exposure system to be combined with reversal development and toner must be prepared which can be electrostatically charged with the same polarity as the photoreceptor. When dot exposure is used, the photoconductive semiconductor of the a photoreceptor must have a light decay curve which is suitable for the above-described spot of light's distribution curve.

Accordingly, when low magnitude of exposure, in the gentle slope portion of the spot of light's distribution curve, wherein the spot of light is for erasing electrostatic charge of the photoreceptor, is picked up by the electrostatic charge erasing action in the region of low magnitude of exposure, the electric potential distribution curve of the formed latent image of a spot becomes funnel-shaped, with a broadly extended edge. Therefore, the peripheral portion of the image developed by the toner becomes blurred and fog also occurs.

Accordingly a photoreceptor must be designed to meet the requirements to form a clear peripheral image.

When the subsequent image is developed, the potential of the photoreceptor surface is not reduced to the non-development level because of absorption of light by the deposited toner on the photoreceptor which was not transferred to a transfer paper when the previous image was developed. Image density is decreased at the portion where the potential is not reduced to the non-development level.

SUMMARY OF THE INVENTION

It is an object of the present invention to provide an improved image forming method in which a photoreceptor with a shorter circumference than the length of a printed toner image is used and the effect of residual toner on the previous image portion on the photoreceptor is eliminated.

Another object of the present invention is to provide an image forming method which can form a sharp dot image by dot exposure and reversal development.

The image forming method of the present invention comprises (a) a step to uniformly electrostatically charge a photoreceptor with a shorter circumference than the length of images to be transferred;

(b) a step to expose the photoreceptor according to image information;

(c) a step of removing the residual toner particle on the non-image portion on the photoreceptor and developing the image portion on the photoreceptor with toner particle at the same time or successively, wherein the toner has a spectral characteristic which allows exposing light to pass through the toner particles; and (d) a step to transfer a toner image formed on the photoreceptor to a transfer medium.

In a preferable embodiment of the present invention, exposure is conducted digitally by a spot of light. It is preferable that the electrostatic charge on the image portion on the photoreceptor is erased by exposing the image. In this case, the toner which can be electrostatically charged to the same polarity as the photoreceptor is used.

The image forming method of the present invention comprises:

(a) a step to uniformly electrostatically charge a photoreceptor with a shorter circumference than the length of images to be transferred, wherein the photoreceptor has low effective sensitivity when exposed to light with low magnitude of exposure and has high effective sensitivity when exposed to light with middle or high magnitude of exposure;

(b) a step to expose the photoreceptor according to image information;

(c) a step of removing the residual toner on the non-image portion on the photoreceptor and developing the image portion on the photoreceptor with toner particles at the same time or successively; and (d) a step to transfer a toner image formed on the photoreceptor to a transfer medium.

In the embodiment of the present invention, infrared rays having a wavelength of not less than 750 nm are preferably used in image exposure. A white light source covered with an infrared transmission filter may also be used.

In this embodiment, GaAlAs infrared light emitting diodes LN 172 (manufactured by Matsushita Electric Co.), the characteristics of the light emission spectrum of which are shown in FIG. 4, and a halogen lamp combined with an infrared transmission filter IR-D70 (manufactured by Toshiba Gaishi Co.), were used. FIG. 5 shows its spectral transmittance characteristics.

BRIEF DESCRIPTION OF TEE DRAWINGS

DETAILED EXPLANATION OF THE INVENTION

Figure 1:
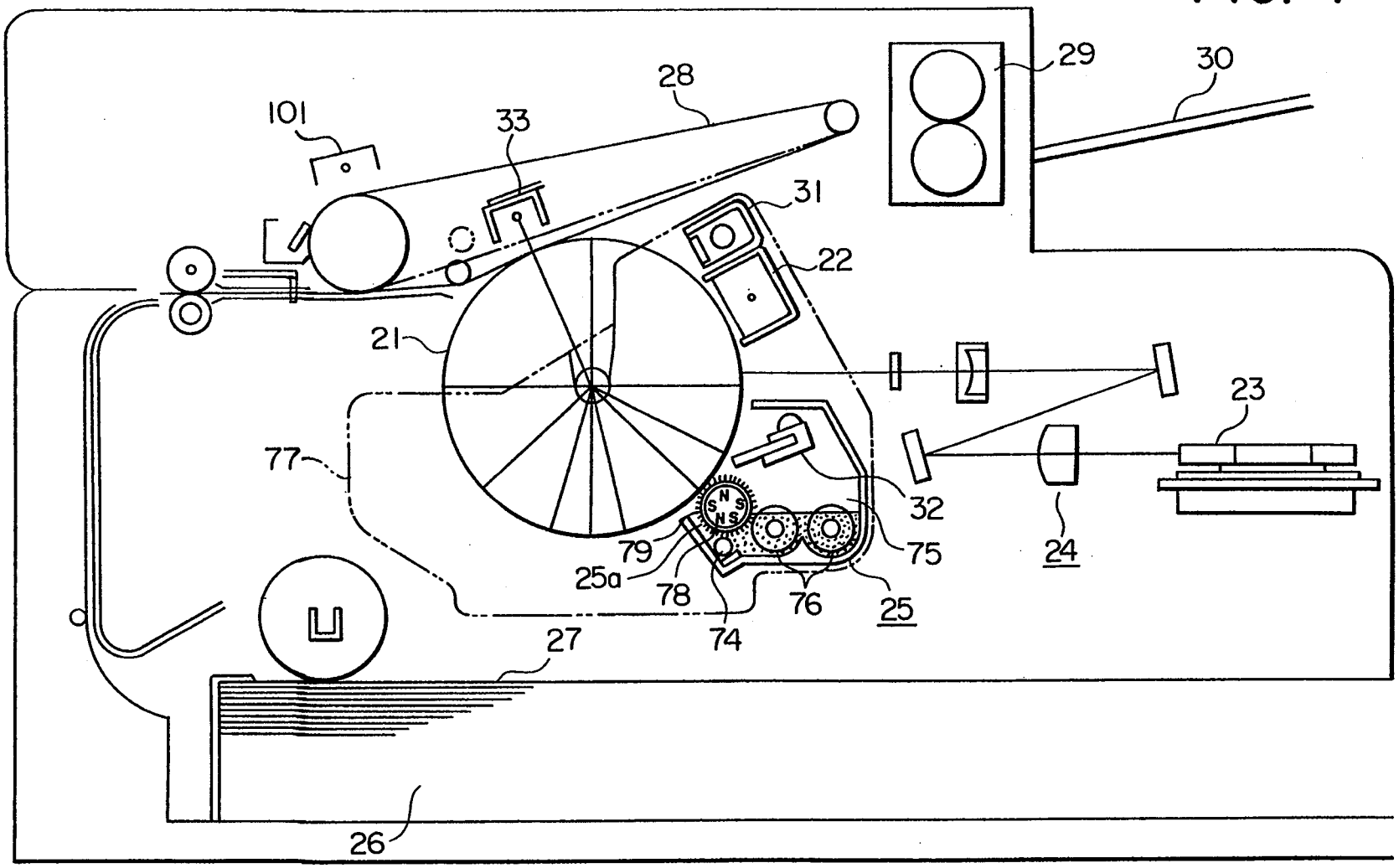
FIG. 1 is a schematic illustration of the image forming apparatus.

When an electrostatic latent image is formed on a photoreceptor, electrostatic charging, image exposing, developing, and transferring have been conducted under the conditions that there is no residual toner on the photoreceptor after its surface has been completely cleaned.

However, it is not always necessary to remove all the toner from the surface of the photoreceptor. Since the new toner electrostatically adheres to the portion of the photoreceptor where a new image is formed, the residual toner on the portion can be left as it is as long as the same toner is used.

Furthermore, unless the residual toner obstructs electrostatic charging, image exposing, and developing, the residual toner which was left after the previous image was formed, may be conveyed to the transfer process after unnecessary toner, or toner injurious to image quality, is removed from the surface of the photoreceptor.

When the photoreceptor is uniformly charged anew, and ions are supplied by corona discharge of the scorotron charger while the residual toner is left as it is on the surface of the photoreceptor, ions can almost uniformly reach the surface of the photoreceptor, except for the contact points of the residual toner. The reason for that is as follows. Although the flow of ions go in a prescribed direction to reach the surface of the photoreceptor, the flow is disturbed and ions go under the shade of the residual toner particles because ions crash against air particles on the way from the charger to the photoreceptor or charging occurs again on the residual toner particles.

Electrostatic charge of the residual toner hardly affects uniformity of photoreceptor charging since the amount of electrostatic charge of the residual toner is relatively small compared with a large amount of electrostatic charge of the generated ions. Accordingly, the residual toner hardly affects uniformity of photoreceptor charging.

In image exposing, as long as toner particles are not so large, exposing light goes under the shade of the toner particles due to diffraction caused by the peripheral portion of the particles. When exposing light is not perfect condensed light but dispersed light, it can be considered that the light has an exposing effect on the photoreceptor even if the effect is not perfect. However, it is difficult to eliminate obstruction to exposure in the following cases: when a coherent laser beam is used for exposing images, when toner particles are not transparent with regard to exposing light, and especially when the residual toner occupies a small spotted area.

The residual toner conveyed to the developing process is classified into two types. One is the toner which adheres to the portion where a new image is formed. This toner is put into practical use to form images. The other is the toner which adheres to the non-image portion. This toner is unnecessary and injurious to image quality.

Since Coulomb force between the toner particles to be eliminated and the surface of the photoreceptor is already attenuated as a result of uniform photoreceptor exposure and image exposure, the unnecessary toner can be easily removed from the photoreceptor by the developing magnetic brush.

Especially in the case of reversal development, in which the polarity of the photoreceptor is the same as that of the toner, the development bias is so effective in the non-image portion that even newly charged toner can not adhere to the photoreceptor surface. For that reason, the residual toner can not adhere to the non-image portion of the photoreceptor and is easily removed from the surface by the developing magnetic brush.

In other words, in the magnetic brush developing system in which reversal development is adopted, the residual toner hardly adheres to the photoreceptor surface apart from the portion where a new image is formed.

In view of the above, the image forming method in which a photoreceptor with a small circumference is used, the details of which will be explained as follows, can be realized. A photoreceptor, the circumference of which is shorter than the length of the toner image made from the document image, is used in this method. In other words, the image printing length is longer than the photoreceptor circumference. In order to print out the toner image, a prescribed circumferential portion of the photoreceptor is used twice.

In the present invention, toner which is transparent to image exposing light is used and exposing light passes through the residual toner. As a result, obstruction to exposure caused by the residual toner can be eliminated. It is preferable that the image is exposed by infrared rays, the wavelength of which is not less than 750 nm, so that the transparent toner can be easily prepared.

In the present invention, a photoconductive semiconductor, the details of which will be described below, is used as a photoreceptor. The photoconductive semiconductor is subject to the low magnitude of light exposure reciprocity law failure regarding electric potential light decay sensitivity. For that reason, in the light decay curve of the photoconductive semiconductor, the semiconductor has a low decrease rate for low magnitude of light exposure and a high decrease rate for middle or high magnitude of light exposure. Particularly, the above-described type of image forming is conducted to form a sharp image by dot exposure and reversal development.

Furthermore, in the present invention, it is preferable that spherical toner with fluidity, uniformity of electrostatic charging, and regularity of consumption, is used, and further preferably the hardness of the light sensitive layer of the photoreceptor is increased so that the spherical toner can not mechanically adhere to the surface of the photoreceptor, and the toner transfer ratio is increased. Furthermore, the magnetic brush developing method is adopted in order to guarantee high quality images.

The present invention will be described in detail as follows.

Concerning the colored toner of the invention, the absorption spectrum of the colored toner must be taken into account. Accordingly, it is preferable to expose the images to light with a wavelength which is least absorbed by the colored toner. In this way, exposing light passes through the residual toner on the photoreceptor and the electrostatic latent image can be stably formed. From this point of view, a laser beam with a longer wavelength is generally better than visible light.

Especially when a laser beam with long wavelength, represented by a semiconductor laser beam, is used, it can be so designed that transmittance in the infrared region is large even if the toner is colored.

For instance, black toner can be made by blending pigments which are used for Y, M, and C toner. This black toner allows high transmittance by infrared rays. For that reason, even if the toner adheres to the photoreceptor when exposure is conducted, the toner scarcely affects light decay of the electrostatic charge. The following are the coloring agents mixed in the binder resin of the toner. They are Benzidine Yellow G (C.I.21090), Permanent Yellow DHG manufactured by Hoechst Co., Brilliant Carmine 6B (C.I.15850), Rhodamine 6G Lake (C.I.45160), Rhodamine B Lake (C.I.45170), Phthalocyanine Blue non Crystal (C.I.74160), Phthalocyanine Green (C.I.74260), carbon black, Fast Yellow 5G, Fast Yellow 3G, Fast Red G, Fast Red HRR, Fast Red 5B, Fast Black HB, Zapon Fast Black RE, Zapon Fast Black B, Zapon Fast Red BB, Zapon Fast Red GE, Zapon Fast Yellow G, and Quiancridone Red (C.I.465000). The content of these pigments is 1 to 20 wt per 100 wt of the binder resin.

Examples of the resin used in the invention are styrene-acrylic type copolymer resin which is obtained by copolymerization of styrene type monomers such as styrene with acrylic acid ester type monomers such as butyl acrylate and/or methacrylic acid ester type monomers such as methyl methacrylate, polyester resin, polyamide resin, polyurethane resin, or polyurea resin.

The average size of toner particles is preferably not more than 20 μm. Even when toner particles, the average size of which is not more than 20 μm, are left on the surface of a photoreceptor after image transfer, they cause no practical problems in absorbing light.

In order to improve electrostatic charging efficiency by increasing toner liquidity, it is preferable to use spherical particle toner. The methods to make spherical particle toner are as follows. For instance, the thermal method to make spherical particle toner, the method to make spherical particle toner by melting the surface of toner particles in an air flow, the method to make spherical particle toner by pulverizing toner particles at a high temperature, the thermal method to make spherical particle toner by melting the surface of toner particles, and the method to make spherical particle toner in a solution such as the granulating polymerization method.

The average particle size of spherical particle toner is preferably 1 to 7 μm. When the average particle size is smaller than 1 μm, the surface of a photoreceptor cannot be completely cleaned. When the average particle size is more than 7 μm, part of the image exposing light is absorbed by the toner. Absorption of light exerts a harmful influence on image quality.

In the present invention, it is preferable to use an electrostatic charge controlling agent in order to control the electrostatic charge of toner and electric polarity of charged toner. The following are used as electrostatic charge controlling agents: nigrosine type dye, metal complex dye, ammonium salt compounds, and aminotriphenyl methane type dye.

The content of the electrostatic charge controlling agent is 0 to 5 wt per 100 wt of the binder resin of the toner.

In order to improve the offset property, polyolefin may be added as the binder resin.

Furthermore, inorganic fine particles as liquidity improving agents may be mixed into the toner of the invention. The following inorganic fine powder may be used: silica powder, alumina, titanium oxide, barium titanate, magnesium titanate, calcium titanate, strontium titanate, zinc oxide, silica sand, mica, wollastonite, diatomaceous earth, chromium oxide, cerium oxide, ironred, diantimony trioxide, magnesium oxide, zirconium oxide, barium sulfate, barium carbonate, calcium carbonate, silicon carbide, and silicon nitride. It is especially preferable to use silica fine powder.

Metals which show ferromagnetism such as iron including ferrite and magnetite, cobalt, and nickel, various alloys with ferromagnetism, or compounds containing these elements are used as the ferromagnetic body which is applied to the carrier of the developer and the magnetic toner.

The following are thermosetting resins used as the binder in the present invention. They are phenol resin, urea resin, epoxy resin, unsaturated polyester resin, melamine resin, silicon resin, polyurethane resin, diallyl phthalate resin, and furun resin. The resin which is excellent in electric insulation, coat formation, physical properties, and chemical resistance is chosen among them. In the present invention, it is preferable to use the phenol resin with the construction unit shown by the following general formula.

The general formula

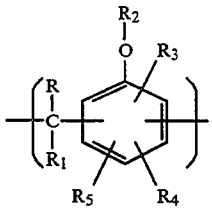

In the formula, R and $R_1$ are hydrogen atoms or methyl groups, $R_2$ is a hydrogen atom or an epoxy group. $R_3$, $R_4$, and $R_5$ are a saturated or unsaturated chain type hydrocarbon group with 1 to 3 carbon atoms which may have a halogen atom, a hydrogen atom, a hydroxy group, a nitro group, a cyano group, an amino group, a carboxy group, a sulphone acid group or its salt, or a substituent group.

The degree of polymerization of the above-described resin is 2 to 10,000. Preferably it is 2 to 100.

The phenol resin expressed by the above-described general formula which can be effectively used is denatured by the resin or its monomer such as melamine, lignin, chroman, indene, hydrocarbon, polyvinyl alcohol, fatty acid amide, acetate, lactone, acetal, chlorophenol, thiophene, or styrenated phenol. Refer to Japanese Patent Publication Open to Public Inspection No, 123035/1979.

The photosensitive semiconductors used in the present invention are phthalocyanine photoconductive pigments described in Japanese Patent Publication No. 34189/1973, 4338/1974, 17535/1973, 30328/1972, 30329/1972, 38543/1975, and 23738/1976.

To be more exact, they are phthalocyanine pigments which are represented by a general structural formula $(C_3H_4N_2)_4Rn$, in which R represents the following: hydrogen, deuterium, lithium, sodium, potassium, copper, silver, berylium, magnesium, calcium, zinc, cadmium, barium, mercury, aluminum, gallium, indium, lantern, neodymium, samarium, europium, gadolinium, dysprosium, holmium, erbium, thulium, ytterbium, lutetium, titanium, tin, hafnium, lead, thorium, vanadium, antimony, chromium, molybdenum, uranium, manganese, iron, cobalt, nickel, rhodium, palladium, osmium, and platinum. The number n represents 0 to 2. Especially non-metal phthalocyanine and $\alpha$, $\beta$, $\gamma$, x, $\pi$, or $\epsilon$ type copper phthalocyanine are preferable among them. The average particle size of them is preferably 0.1 to 0.01 $\mu$m.

In the light decay curve of the photoconductive semiconductor, assuming that a light sensitivity is represented by $E\frac{1}{2}$ when the electrostatic potential is decayed to $\frac{1}{2}$ and a light sensitivity is represented by E9/10 when the electrostatic potential is decayed to 9/10 at the initial stage of exposure, a potoconductive semiconductor which satisfies the following relation is preferable.

$$1<(E\tfrac{1}{2})/(E9/10)$$

It is more preferable that the photoconductive semiconductor satisfies the following relation.

$$2\leqq(E\tfrac{1}{2})/(E\ 9/10)$$

The phthalocyanine receptor is not sensitive to light with low magnitude of exposure. When the amount of exposed light is small, the electrostatic potential decays little and the light decay curve is shaped like a plateau. When the amount of exposure exceeds a certain limit, the curve declines sharply.

Therefore, at the peripheral portions of images on an image exposure surface where the magnitude of exposure is low because of light diffraction, a typical example is a rising portion of exposure intensity at the peripheral portion of an image in dot exposure and an ending portion of exposure intensity at the peripheral portion of the image, the electrostatic charge rises and declines sharply to form a sharp image, wherein the electrostatic charge is not lost by exposed light with low exposure intensity.

The following are binder resins used in the present invention. They are electric insulating resins such as styrene resin, acrylic resin, vinyl chloride-vinyl acetate copolymer, vinyl acetate-methyl methacrylate copolymer, styrene-butadiene copolymer, vinyl toluene-butadiene copolymer, polycarbonate resin, polyurethane resin, phenol resin, melamine resin, furun resin, or epoxy resin. Phenol resin is preferable among them.

The photoreceptor of the present invention is manufactured as follows. First of all, the following are prepared: the above-described photoconductive semiconductor fine powder, resin, intensifying dyes such as rose iron oxide, auramine, brom phenol blue, brom thymol blue, and fuchsine, other intensifiers such as 2,4,7-trinitro-9-fluorenone, 2,4,5,7-tetranitro-fluorenone, and organic solvents such as benzene, toluene, xylene, trichloro, ethylene, ethyl acetate, acetone, and methyl ethyl keton. The paint for the lightsensitive layer is obtained by mixing and dispersing 100 parts by weight of the photoconductive powder, 1 to 100 parts by weight of the resin, 0.05 to 10 parts by weight of the intensifying dye, and 50 to 5000 parts by weight of the organic solvent. The lightsensitive paint obtained in this way is coated on the support. The details of the support are described as follows. The support used in the invention is made from a metal such as copper, nickel, aluminum, and stainless steel, a paper or a plastic film on which a metal such as aluminum, gold, silver, copper, and nickel or a metal oxide such as stannous oxide are vapor-deposited or laminated, and a paper or a plastic film on which resin is coated, the resin containing the above-described metallic powder, metal oxide powder, and carbon black powder. The photoreceptor of the invention is made by coating the photosensitive materials to form a layer on the electric conductive support so that the dry layer thickness is 10 to 50 $\mu$m. As occasion demands, an intermediate layer made from a high molecular compound or a rectifying semiconductor may be provided.

A latent image forming process by which an excellent dot latent image is obtained, is provided by the above-described photoreceptor on which pulse-modulated dot exposure is conducted after the electrostatic charging process. This photoreceptor can be applied to both contact type developing and non-contact type developing. This photoreceptor is especially applied to the image forming apparatus in which reversal development suitable for non-contact development is used.

In the present invention, account is taken of the absorption spectrum of the toner. When exposure is conducted, it is desirable to use light with a wavelength of not less than 750 nm which is hardly absorbed by the toner. From this point of view, a laser beam with a long wavelength is more suitable for the apparatus of the present invention than visible light. The light with the above-described wavelength may be obtained with a filter.

Laser beams using gas such as He-Ne, He-Cd, or Ar and semiconductor laser beams such as GaAlAs are used for dot exposure. The wavelength is generally more than 700 nm.

Two component developer is suitable for reversal development in the present invention because it is adequate for multipurpose use. Reversal development is favorable to remove the residual toner from the photoreceptor after an image has been transferred. Since the photoreceptor and the toner are electrostatically charged to the same polarity in reversal development, cleaning is conducted smoothly.

It is preferable that the AC component is superimposed on the DC bias in reversal development. This AC component forms an alternating electric field in the developing region and it has the effect of returning the redundant toner on the photoreceptor to the developing sleeve when too much toner adheres to the photoreceptor. It also has the effect to accelerate developing when the photoreceptor lacks toner. Accordingly, when toner adheres to the photoreceptor beforehand, the harmful influence of the toner can be reduced.

In this way, the influence caused by the residual toner on the photoreceptor after transfer can be eliminated in the present invention.

When the above-described light is used for exposure, the harmful influence of the residual toner on the photoreceptor after transfer can be avoided by using toner with high transmittance, superimposing the AC component on the DC developing bias, and adopting the magnetic brush developing method.

EXAMPLE

Referring now to the drawings for a more complete understanding of the invention, the details of the invention will be explained as follows.

FIG. 1 is a schematic illustration of an image forming apparatus of the present invention.

In the image forming apparatus, exposure is conducted by a semiconductor laser unit. In this apparatus, the contact developing method is adopted, wherein the magnetic brush using two component developer are used. Development and cleaning are conducted at the same position of the photoreceptor.

This apparatus can also be connected with the host system (not shown in the drawing) which is the external unit of an electronic computer or a word processor through a transmission controlling circuit (not shown in the drawing) such as an interface circuit.

When the signal to start printing is received, the photoreceptor 21 is rotated and the photoreceptor 21 is electrostatically charged by the charger 22. Then, the electrostatically charged photoreceptor 21 is scanned for exposure by a modulated laser beam, the wavelength of which is 800 nm, with the optical system 24 including the polygon scanner 23 to form an electrostatic latent image. The latent image is developed by the magnetic brush in the developing unit 25 and a toner image is formed. The toner image is transferred onto the transfer paper 27, conveyed from the cassette 26 by the transferring charger 33. After that, the toner image is fixed on the transfer paper 27 by the fixing unit 29 and the transfer paper 27 is delivered onto the tray 30.

In the above-described developing unit 25, the following are installed: the developing roller 25*a* which consists of the magnet 78 and the developing sleeve 79; the magnetic rod 74 which is placed on the upstream side of the rotation of the developing roller 25*a* with regard to the developing position where the photoreceptor 21 comes into contact with the development magnetic brush formed on the surface of the developing roller 25*a;* and the developer stirring unit 76 which is mounted in the developer container 75. Furthermore, the developing unit 25 and the photoreceptor 21 are built into the casing 77.

In the above-described developer container 75, the developer which is composed of spherical particle toner, the average particle size of which is 7 μm, and the ferrite carrier coated with resin, the average particle size of which is 80 μm, are contained. The AC component of 3 KHz, 1 KV is superimposed on the DC component of +500 V to make the developing bias for reversal development.

The above-mentioned developing roller 25*a* is composed of the magnet 78 and the developing sleeve 79, which is provided around the circumference of the magnetic roller 78 and can be rotated freely around the magnet 78. The electric potential of the photoreceptor surface 21 and the conditions of the toner on the photoreceptor 21 vary according to the stage of the developing process.

For instance, the photoreceptor 21 is elecrostatically charged by the charger 22 to +600 V. At this moment, the toner 't' which is left on the photoreceptor 21 because it was not transferred to a transfer paper in the previous transfer process, also is charged and at the same time the portion of the photoreceptor 21 on which the toner 't' exists is also charged.

Since the scorotron charger was used to make the surface potential uniform in this example, the potential of the photoreceptor portion where the toner 't' exists is a little lower than that of where the toner 't' does not exist. This difference of electric potential does not cause any practical problems.

The photoreceptor 21 is scanned by a pulse-duration modulated laser beam with the optical system 24 and its surface potential is decayed to form an electrostatic latent image.

According to the light decay characteristics of phthalocyanine, the electric potential of the peripheral portion of the formed electrostatic latent image rises and declines sharply in the light decay curve. The curve is box-shaped.

The electrostatic latent image is developed by the magnetic brush in the developer 25. At the same time, the residual toner 't' left on the photoreceptor after transferring, which is unnecessary to image forming, is removed from the photoreceptor by the magnetic brush in the developer 25 to clean its surface.

After the electrostatic latent image on the photoreceptor 21 has been changed to a toner image by toner 't' supplied by the developing unit 25, the toner image is transferred to the transfer paper 27 on the belt 28 by the transferring electrostatic charger 33.

High electric potential with a polarity which is reverse to that of toner 't' with positive charge, is impressed on the transferring electrostatic charger 33. The transferring electrostatic charger 33 conducts negative corona discharge from the rear of the belt 28 to charge the toner negatively. As a result, toner 't' is attracted to the transfer paper 27 by the action of the transferring charger 33. After the toner image was transferred to a transfer paper, the belt 28 is discharged by the discharger 101.

In addition to the motion described above, the uniformly illuminating lamp 31 is installed immediately before the electrostatic charger 22 wherein the photoreceptor 21 is illuminated by the uniformly illuminating lamp 31 in order to equalize the electric potential of the photoreceptor before it is electrostatically charged by the electrostatic charger 22. This process is effective to obtain high quality images. It is desirable that the toner is transparent to this illuminating lamp in the same way as it is to the exposing light.

The cleaning blade 32 which can come into contact with the photoreceptor or can be kept away from it, is also effective to eliminate the difficulty of establishing conditions in which the residual toner after transferring is used for development and removed from the photoreceptor in the developing region at the same time.

When an image is formed, this cleaning blade 32 is kept in press against the photoreceptor 21 to scrape off the residual toner from the photoreceptor 21 and to keep it on the cleaning blade 32, and the cleaning blade 32 is released from the photoreceptor 21 after image forming is completed (after the electrostatic latent image is developed by the magnetic brush). The kept toner can be easily cleaned down from the photoreceptor 21 by the magnetic brush in the developing unit 25.

The above-described photoreceptor 21 will be explained as follows.

The photoreceptor 21 is composed of an aluminum tube, the outer diameter of which is 30 mm and the thickness of which is 0.8 mm, and a photosensitive layer coated over the surface of the tube.

The above-described photosensitive layer is made as follows.

| | |
|---|---|
| ε type copper phthalocyanine pigment | 1 g |
| Lionol Blue ER manufactured by Toyo Ink Co. | |
| Desmorhen 800 manufactured by Nippon Polyurethane Co. | 2 g |
| Polyester polyol resin | |
| Hexamethylene diisocyanate | 2 g |
| Methyl ethyl ketone | 6 g |

The above-described composition was dispersed by an ultrasonic disperser for 10 minutes at room temperature and coated on a conductive support in which aluminum foil of 10 μm was laminated on a polyester layer of 80 μm by a rotary coating machine at a speed of 800 rpm so that the dry thickness of the layer could become 15 μm. After that the photoconductive layer on the support was left in a drier the temperature of which was 160° to 170° C. for about 2 hours.

Figure 2:
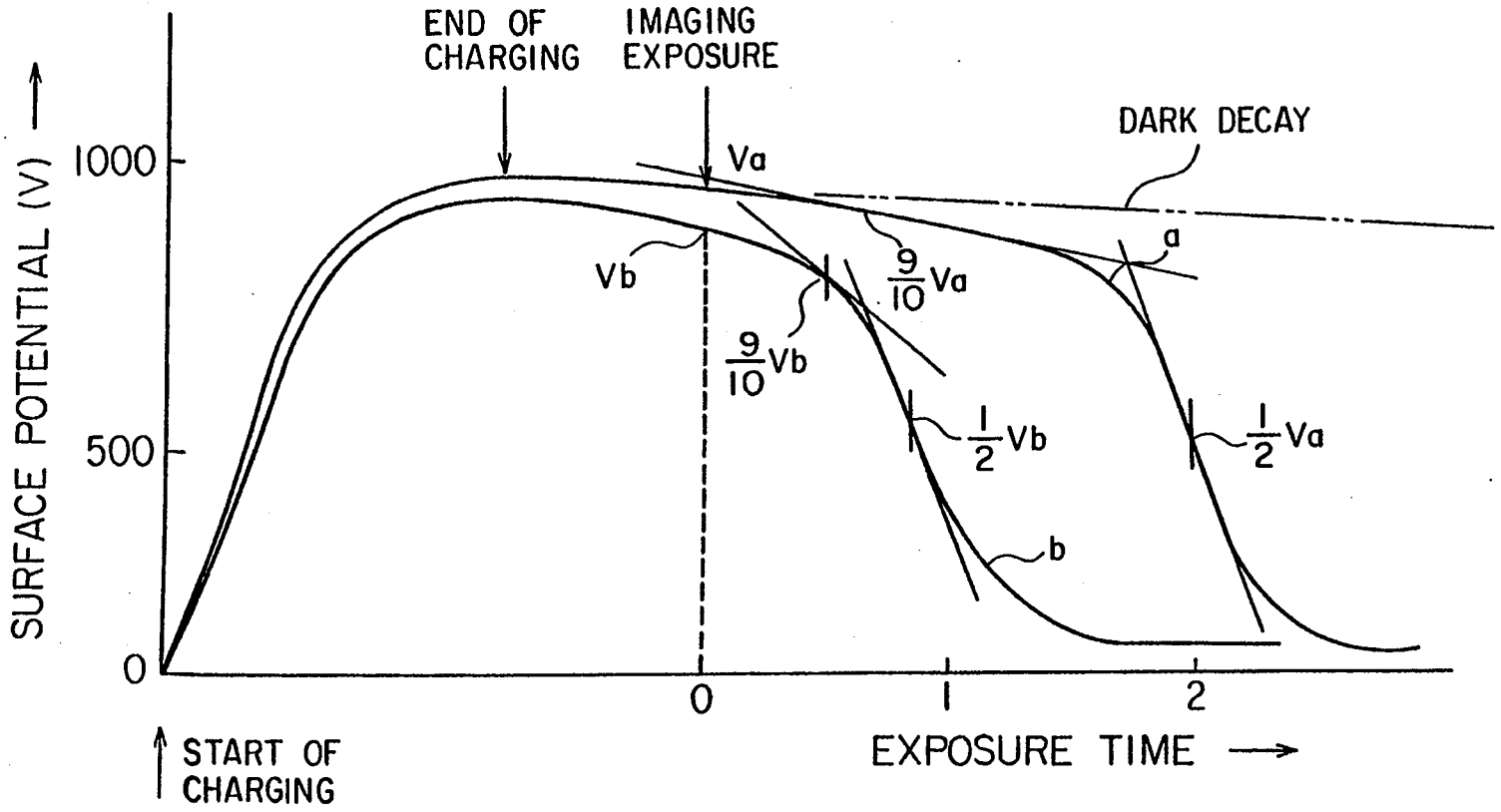
FIG. 2 is a graph which shows the electric potential characteristics of the photoreceptor.

Two kinds of electrostatic characteristics of the photoreceptor made in this way were measured with Electrostatic Paper Analyzer SP-428, manufactured by Kawaguchi Denki Co., according to the measuring processes of Method 1 and Method 2. In the Method 1, the photoreceptor was exposed to image wize light 5 minutes after static charging at 5 Kvolt for 10 seconds, In the Method 2, plane light exposure was effected to the receptor before the steps of the Method 1. The obtained results are shown in FIG. 2 in which the curves 'a' and 'b' express the electrostatic characteristics of te photoreceptor.

Figure 4:
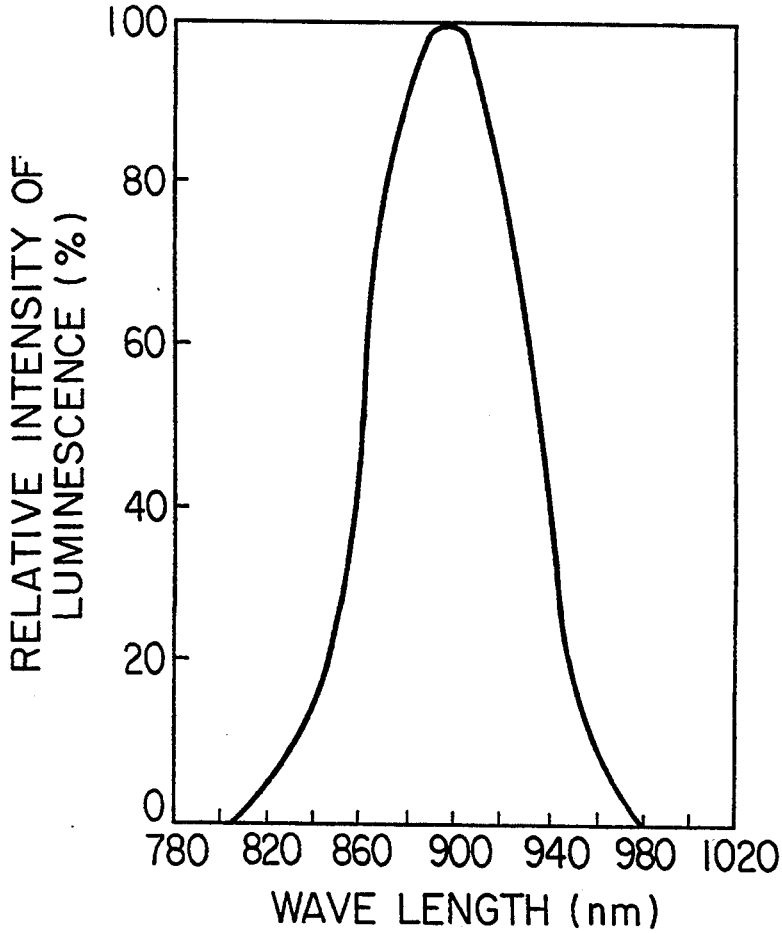
FIG. 4 is a graph which shows the spectral emission characteristics of a GaAlAs infrared emitting diode.

The measuring conditions by Analyzer SP-428 are as follows. Potential of 5 KV was impressed on a Corotron Corona discharger. The distance between the discharging wire and the surface of a sample was kept at 9 mm and the sample was given a positive electric charge. Both image exposure and erasing exposure were conducted by exposing the surface of the sample at a luminance of 3 luxes by tungsten light of 2854° K. through an infrared transmission filter whose characteristics are shown in FIG. 4.

The ratios of sensitivity were as follows.

Method 1 . . . $(E\ \frac{1}{2})/(E\ 9/10)=8.0$

Method 2 . . . $(E\ \frac{1}{2})/(E\ 9/10)=2.7$

FIG. 2 represents the results of measurement of the electric potential characteristics of the obtained photoreceptor, wherein the electrostatic potential characteristics cover the process from electrostatic charging to light decay.

The composition of the developer is as follows.

| Toner | |
|---|---|
| Polystyrene | 45 wt |
| Polymethyl methacrylate | 44 wt |
| Barifast (Charging controlling agent) | 0.2 wt |
| Colorant | 10.5 wt |

After the composition described above is mixed, kneaded, and classified, spherical particle toner can be obtained by processing with hot air.

| Carrier coated with resin | |
|---|---|
| Core: Spherical particle ferrite | |
| Coating resin: Styrene Acryl | (4:6) |
| Magnetization | 45 emu/g |
| Particle size | 50 μm |
| Specific gravity | 5.2 |
| Specific resistance | not less than $10^{13}$ Ωcm |

The above-described coating resin was sprayed over the core and dried to form the carrier.

Figure 3:
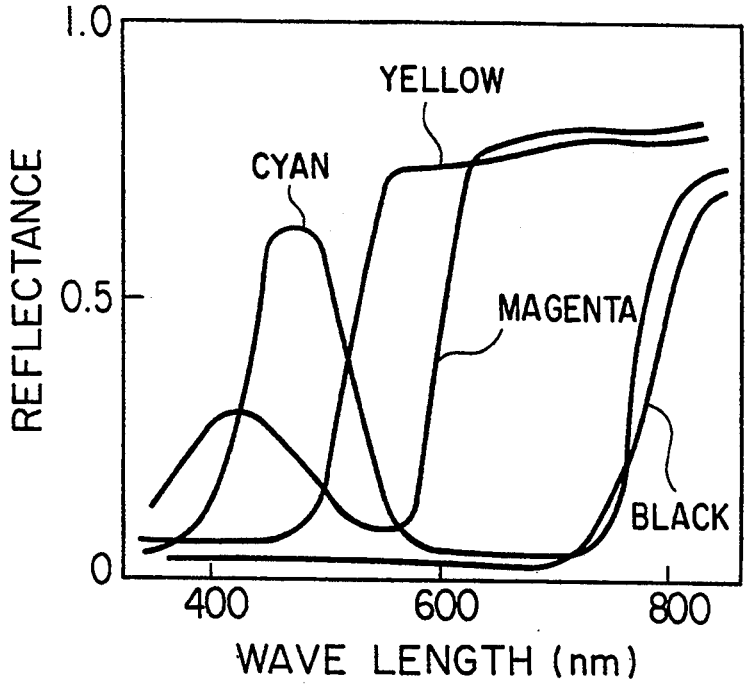
FIG. 3 is a graph which shows the spectral reflectance of the toner.

FIG. 3 shows the data of the spectral characteristics of the toner which is preferably used in the present invention. The spectral characteristics of the toner were measured as follows. A transparent pressure sensitive adhesive double-sided tape was put on a white board in order to make an adhesive surface. The toner was uniformly rubbed against the adhesive surface. In this way one or two layers of toner were made on the surface and the spectral reflectance was measured. The measurement results were corrected with the spectral reflectance measured when there was no toner on the surface. As the result of the correction, the spectral reflectance of the toner was obtained.

The above-described colorant may be used in order to obtain toner with the spectral characteristics shown in FIG. 3. A plurality of colorants were used to make black toner. The measurement was carried out with the spectro-photometer (HITACHI type 330) manufactured by Hitachi Seisakusho. The wavelength of the measured light was in the range of 360 to 850 nm.

It is especially preferable that the spectral reflectance exceeds 50% so that the toner particles can transmit the exposing light effectively.

Various kinds of light sources which emit infrared rays or a white light source covered with an infrared transmission filter may be used as the image exposing light source.

Figure 5:
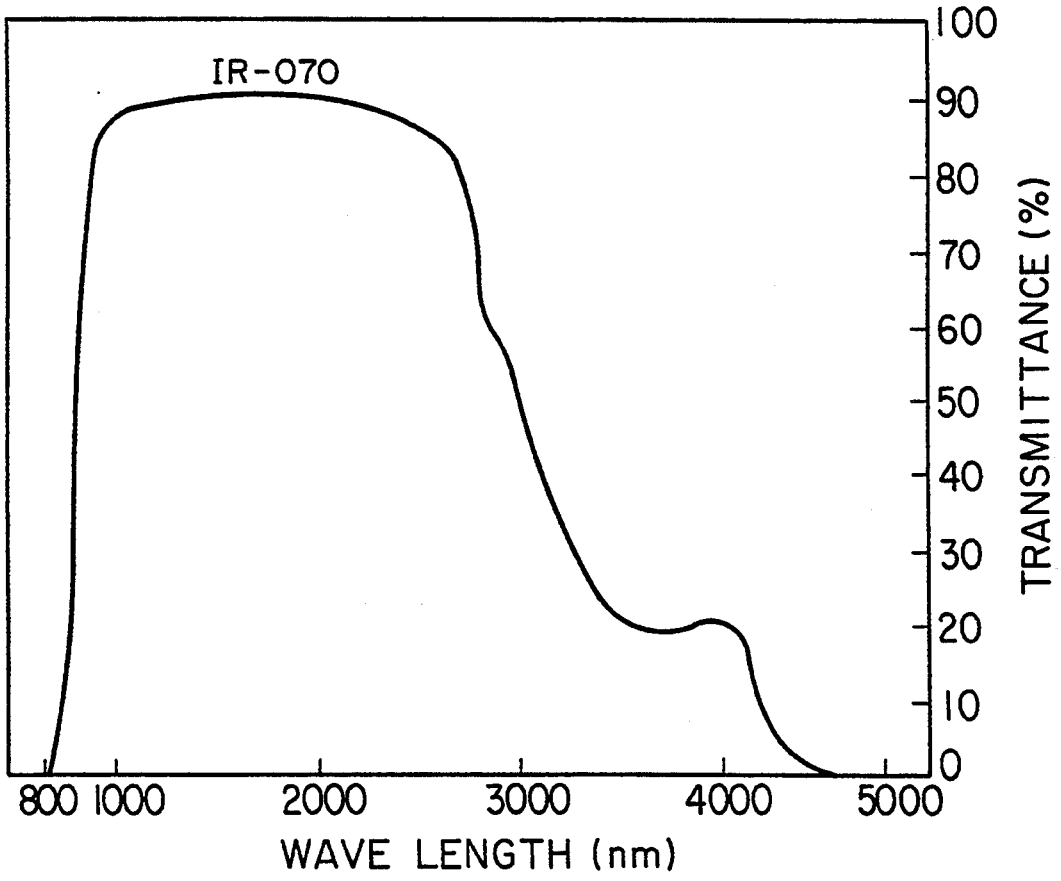
FIG. 5 is a graph which shows the spectral transmittance characteristics in the case of combining a halogen lamp with an infrared transmission filter.

In this example, a GaAlAs infrared light emitting diode (manufactured by Matsushita Denki Co. type LN 172; the spectral distribution in FIG. 4 shows its light emitting spectral characteristics) is combined with a halogen lamp and an infrared transmission filter (manufactured by Toshiba Glass Co. type IR-D70) to compose an exposing light source. The characteristics of its spectral transmittance are shown in FIG. 5.

What is claimed is:

1. A single color toner image forming method, said method comprising;

(a) electrostatically charging a photoreceptor so that said photoreceptor has an electrostatic potential;

(b) exposing said photoreceptor to an exposing light corresponding to image information, to form a latent image, said photoreceptor having a decay characteristic whereby, when an amount of said exposure light is below a critical point, a drop in potential is only slight, and when said amount of exposure light exceeds said critical point, said potential drops sharply;

(c) developing said latent image on said photoreceptor with toner particles to form a toner image, said toner particles having spectral characteristics which allow said exposing light to pass therethrough to said photoreceptor;

(d) transferring said toner image from said photoreceptor to a transfer material;

(e) electrostatically charging said photoreceptor without cleaning residual toner particles from a previous toner image remaining on said photoreceptor;

(f) exposing said photoreceptor, in the presence of said residual toner particles, with a subsequent light to form a subsequent latent image, (g) cleaning said residual toner particles from said previous toner image on said photoreceptor and developing said subsequent latent image to form a subsequent toner image; and (h) transferring said subsequent toner image from said photoreceptor to said transfer medium, whereby said cleaning for removing said residual toner particles from said previous toner image is completed before said transferring of said subsequent toner image is started.

2. A toner image forming method as claimed in claim 1, wherein the toner particles are spherical.

3. A toner image forming method as claimed in claim 2, wherein an average particle size of the toner particles is not more than 20 μm.

4. A toner image forming method as claimed in claim 3, wherein an average particle size of the toner particles is 1 to 7 μm.

5. A toner image forming method as claimed in claim 1, wherein the exposing light has a wavelength component of more than 750 nm.

6. A toner image forming method as claimed in claim 1, wherein the latent image is developed by a reversal development.

7. The method of claim 1 wherein said developing for forming said latent image is conducted with a magnetic brush formed by toner particles, cleaning of developed areas of said image retainer being simultaneously conducted with said magnetic brush.

8. The method of claim 1 wherein said photoreceptor is a drum having a circumference less than a length of said toner image being transferred.

* * * * *